US010106385B2

(12) United States Patent
Giannetti

(10) Patent No.: US 10,106,385 B2
(45) Date of Patent: Oct. 23, 2018

(54) ANTI-SCRATCH AND ANTI-SLIP DEVICE FOR LIFTING LOADS, PREFERABLY THROUGH USE OF A FORKLIFT

(71) Applicant: Mirco Giannetti, Misano Adriatico (IT)

(72) Inventor: Mirco Giannetti, Misano Adriatico (IT)

( * ) Notice: Subject to any disclaimer, the term of this patent is extended or adjusted under 35 U.S.C. 154(b) by 106 days.

(21) Appl. No.: 15/004,145

(22) Filed: Jan. 22, 2016

(65) Prior Publication Data

US 2016/0137469 A1 May 19, 2016

Related U.S. Application Data

(63) Continuation-in-part of application No. 13/821,346, filed as application No. PCT/IT2011/000222 on Jun. 30, 2011, now abandoned.

(30) Foreign Application Priority Data

Oct. 7, 2010 (IT) ..... PI2010A0109

(51) Int. Cl.
*B66F 9/12* (2006.01)
*B66F 9/18* (2006.01)

(52) U.S. Cl.
CPC ..... *B66F 9/12* (2013.01); *B66F 9/184* (2013.01)

(58) Field of Classification Search
CPC .... B66F 9/12; B66F 9/184; B66F 9/18; B66F 9/182; B62B 3/06; B62B 2203/29
USPC ..... 293/128
See application file for complete search history.

(56) References Cited

U.S. PATENT DOCUMENTS 2,659,506 A * 11/1953 Watkins ..... B66F 9/12 414/785
2,690,271 A * 9/1954 Marietta ..... B66F 9/184 414/623
2,905,349 A * 9/1959 Repke ..... B66F 9/12 414/664
3,572,798 A * 3/1971 Kunevicius ..... B60R 13/04 116/28 R
3,687,502 A * 8/1972 Loew ..... B60R 13/04 293/120
4,294,478 A * 10/1981 Marquette ..... B60R 13/04 293/128
4,498,697 A * 2/1985 McGlone ..... B60R 13/04 293/128
4,708,380 A * 11/1987 Cruz ..... B60R 13/04 280/770
4,735,153 A * 4/1988 Wong ..... B65D 19/0012 108/57.16
5,618,159 A * 4/1997 Wilson ..... B66F 9/12 187/237
5,897,286 A * 4/1999 Whittaker ..... B66F 9/12 187/237

(Continued)

*Primary Examiner* — Michael A Riegelman
(74) *Attorney, Agent, or Firm* — Themis Law

(57) ABSTRACT

An innovative anti-scratch and anti-slip device for lifting loads with the fork of a lift, for example with a forklift, includes three different, overlapping layers. In particular, a first magnetic layer is adapted to be removably applied to the fork; a second, external layer covers the first layer and is made of a rubber material that comes in direct contact with the load, the rubber material providing a seal and not scratching the load; and a third layer that is interposed in an intermediate position between the first and the second layers to stiffen the device.

15 Claims, 8 Drawing Sheets

(56) References Cited

U.S. PATENT DOCUMENTS

| | | | | |
|---|---|---|---|---|
| 7,229,108 | B2 * | 6/2007 | Hochrein | B60R 13/04 293/128 |
| 2002/0105197 | A1 * | 8/2002 | Unterwagner | B60R 13/04 293/128 |
| 2007/0158963 | A1 * | 7/2007 | Debs | B60R 19/42 293/128 |
| 2008/0011530 | A1 * | 1/2008 | Oka | B60W 10/02 180/306 |
| 2009/0140533 | A1 * | 6/2009 | Keough | B60R 19/42 293/109 |
| 2014/0166405 | A1 * | 6/2014 | Bow | B66F 9/18 187/237 |

* cited by examiner

ANTI-SCRATCH AND ANTI-SLIP DEVICE FOR LIFTING LOADS, PREFERABLY THROUGH USE OF A FORKLIFT

FIELD OF THE INVENTION

The present invention refers to the technical field of machines used to support and/or lift loads, such as those in forklift trucks.

In particular, the present invention refers to an innovative anti-scratch and anti-slip device, magnetically applicable and as such removable, to load lifting surfaces, preferably the forks of a lift, thus preventing the development of scratches on the moved material and, at the same time, drastically limiting the risk of having the moved material slip off the load plane.

BACKGROUND OF THE INVENTION

Machines for lifting and supporting loads, such as forklift trucks or forklifts, have long been known.

For example, in the case of forklifts, those machines are provided with forks, generally vertically mobile such to be able to lower and lift loads at will. In such a manner, it is possible to lower the forks to ground level and drive them under the load and then proceed with lifting and transporting the load to a predetermined place. In other cases, the forks are not only provided with a vertical motion, but are also provided with a horizontal motion that allows a mutual approach and separation between them, such to grasp laterally the objects, adapting to their different shapes and dimensions.

A technical problem that is particularly important concerns the protection of the transported object from scratches and, at the same time, the risk having the object slip from the forks. It is in fact known that the direct contact with metal, material of which the forks are made, determines a low coefficient of friction, mainly in the case of lifting of loads which are also made of metal. Moreover, the direct contact of metal with metal causes scratches, wear and contaminations, therefore damaging the load, at least aesthetically.

In the background art, in order to solve such problem, hand-made solutions are put into practice, which include the occasional application of a covering of cardboard around the fork, fixed through an adhesive tape. This solution, apart from requiring some time for the application and therefore resulting uncomfortable, also produces poor results. In fact, the cardboard does not have mechanical characteristics of resistance, and the same goes for the adhesive tape. Under the action of heavy loads (which can easily exceed hundreds of kilos), the cardboard wears quickly, causing a direct contact between the forks and the load, while at the same the tape peels off unexpectedly, precluding the seal of the cardboard against the forks and therefore causing the easy slipping of the lifted object.

The same problem is also present for loads that are arranged on fixed loading platforms.

In US2006/0197348, a protection device is described for doors of parked cars against the impact.

That device comprises an external resilient material, an intermediate metal layer and magnets for applying the device on the door of the car.

Even if such a device were suitable for application on a fork of a forklift, it is not instead suitable for the same purposes as the present invention.

A resilient material, as described in US2006/0197348, is a material resists impact but is not necessarily suitable to prevent scratching of an object it touches. Further, it does not have an acceptable degree of friction to prevent the slipping of the load moved with the forks of the forklift.

Moreover, in US2006/0197348, two separate and distanced magnetic strips are described, which are positioned at the two opposite sides of the metallic strip. In this manner, when a load is lifted, such a device will bend in its central part where the magnet is not present, such to produce a folding that causes the detachment of the device from the fork.

It is thus evident that the device disclosed in US2006/0197348 is not suitable for the purposes of the present invention, even if it could be applicable on a fork of a forklift.

In U.S. Pat. No. 4,498,697, a similar device is disclosed which is also not suitable for the purposes of the present invention, even if it could be applied on a fork of a forklift.

In this case the device comprises an external tube made of rubber which is internally hollow.

This device, when pressed with a heavy load (more than 1,000 Kg, for example), collapses on itself because it performs like a hollow tube and breaks along the folding line.

Moreover, in U.S. Pat. No. 4,498,697 the device is not rigid enough and, when used on the fork of a forklift, folds and detaches from the fork.

SUMMARY OF THE INVENTION

It is therefore the aim of the present invention to provide a device 1, which is easily applicable to a load support surface, in particular a lifting surface of a load or a fork 10 of a lift, and which resolves at least in part the above described drawbacks.

In particular, it is the aim of the present invention to provide a device 1 that can be applied to the lifting surface 10 quickly and easily and that, at the same time, provides both a good seal on the lifted object and a good anti-scratch protective action.

These and other aims are therefore reached with a device 1 for a metallic fork of a lift according to the invention and as described herein.

A device (1) according to the invention comprises:

A first magnetic layer (2) that causes the device (1) to be magnetically applicable to the fork (10) of the lift;

A second rubber layer (4) arranged on the first layer (2), so that the rubber, when a load is lifted with the fork, touches directly the load without scratching it, limiting the slipping thereof; and A third stiffening layer (3) that is interposed between the first (2) and the second layer (4) so as to stiffen the device (1) as a whole, limiting the inflexions thereof;

The magnetic layer and the intermediate layer having substantially the same surface and shape.

A device according to the invention, generally in the shape of a strip, can be easily applicable to any fork or surface in general of a lift, thus providing a protective layer that, on the one hand, hinders the slipping of a load and, on the other hand, protects the load from scratches due to the direct contact with the metal of the fork.

The use of a magnetic strip according to the invention is therefore reliable and, at the same time, is of easy and quick application and removal.

The rubber has a high degree of friction properties and is a good material suitable for protecting the load against scratches.

Having the magnetic layer and the intermediate layer of substantially the same surface and shape provides the advantage that a strip according to the invention does not fold when pressed with a load because it is attached to the fork with a continuous magnetic surface.

Advantageously, the rubber layer is of full material and thus does not have any cavity that runs longitudinally inside.

This hinders an inflection of the rubber when pressed with a high load.

Advantageously, the intermediate layer (3) may be a metallic layer, for example, may be made of iron or steel.

Although other metals can be used (including non ferrous metals), the described metals provide a good rigidity with a relatively low thicknesses.

For example, advantageously, the intermediate layer (3) can be comprised within a range of thickness that goes from 1 mm to 4 mm, and is preferably of 2 mm.

Advantageously, the magnetic layer can have a thickness comprised within a range from 1 mm to 3 mm, and preferably of 2 mm.

These thicknesses allow obtaining adequate magnetic forces and at the same time a relatively low overall thickness of the strip.

To that aim, advantageously, the magnetic layer (2) is configured in such a way as to exert a magnetic force of at least 700 N, and preferably within a range from 700 N and 1500 N.

Advantageously, the second layer made of rubber (4) includes a plurality of beads or bubbles (102) for improving the anti-slip seal of the overlying load.

Advantageously, such a device is strip-shaped so as to substantially trace the shape of the fork, on which it is applied.

Advantageously, in all the configurations, an L-shaped folding (7) can be included on both sides of the strip.

This folding not only contributes to a better seal of the strip on the fork but also, above all, protects concave or convex-shaped loads from direct contact with the corners of the fork.

Advantageously, in a particular configuration of the invention, a press (6) can be further provided, which is arranged on the device (1) to allow grasping the load laterally when the device is applied to the fork.

In this case, the device (1) is L-shaped and comprises an apex (7'), to which the press results connected (6).

Advantageously, a tang (5) can be included for simplifying the detachment of the device from the fork (10), to which it is applied.

Advantageously, in an alternative solution, the terminal end (101) of the device can lack the intermediate metallic layer.

Advantageously, a weight sensor (20) may be further included, integrated to the device (1) such that the lifted object can be weighed at the same time.

Moreover, the present invention includes a mobile surface (10) of a lift, preferably a fork, for lifting a load and having a device (1) as described herein.

Advantageously, the present invention also includes a method of lifting a load with the fork (10) of a lift and of preventing a slipping and damaging of the load, in particular scratches of the moved load.

The method comprises the application of at least one strip (1) on the surface of the fork, with which to operate the lifting of the load, the strip comprising a first magnetic layer (2) such to be magnetically and removably applicable to the fork (10), a second rubber layer (4), arranged on the first layer (2), such that said rubber layer, when the load is lifted with the fork, touches directly the load without scratching it, limiting the slipping thereof, and an intermediate metallic layer (3), interposed between the first (2) and the second layer (4) such to stiffen the strip (1) as a whole, limiting the inflexions thereof. The magnetic layer and the intermediate layer have substantially the same surface and shape.

BRIEF DESCRIPTION OF THE DRAWINGS

Additional features and advantages of a device according to the invention will become clearer from the description that follows of one of its embodiments, made to illustrate but not limit the invention, and having reference to the enclosed drawings, wherein.

DETAILED DESCRIPTION OF EMBODIMENTS OF THE INVENTION

Figure 1:
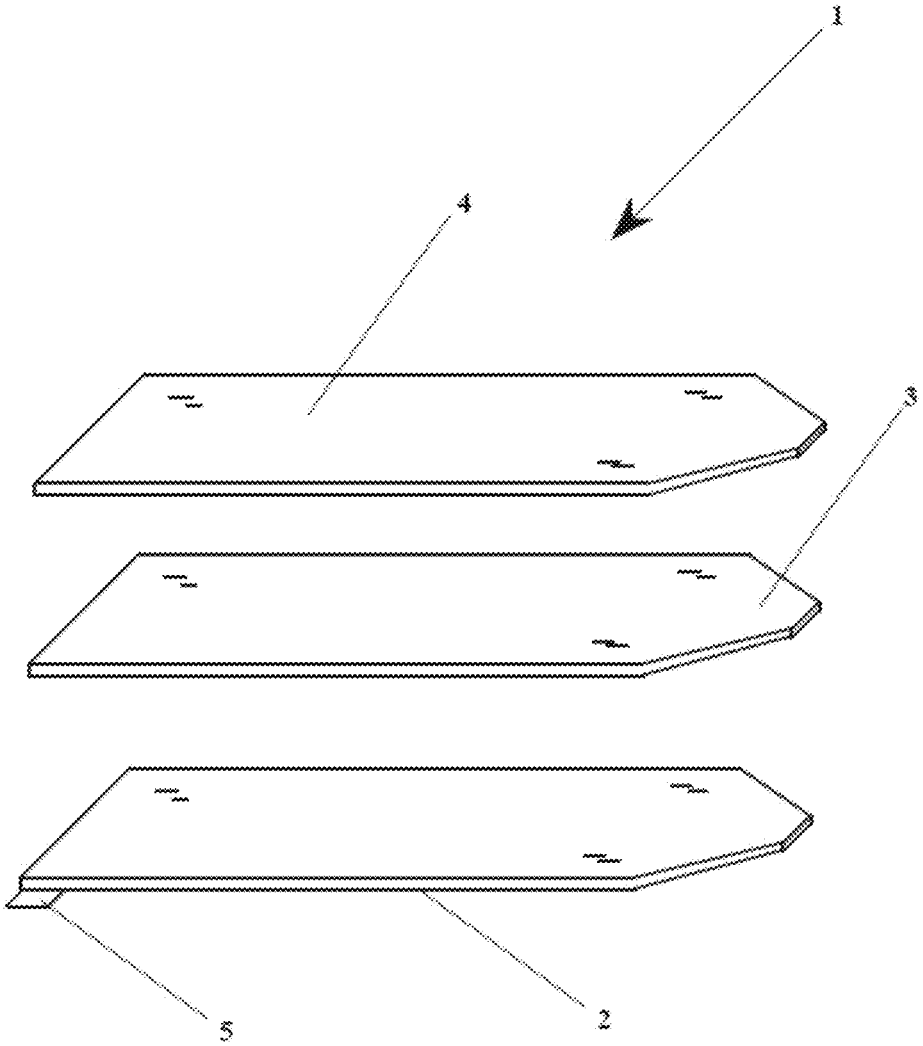
FIG. 1 shows an exploded axonometric view of a device according to the invention, wherein the three layers (2, 3, 4) are represented as separated.

With reference to FIG. 1, there is described a device according to the invention, in particular, a protective and anti-slip device 1 for lifting loads with lifting forks, for example the forks of a forklift.

In particular, FIG. 1 shows an exploded view of three constituent parts (2, 3, 4) of device 1, overlapped one over the other.

Still with reference to FIG. 1, a first layer 2, or inferior layer 2, is composed entirely or in part of a magnetic material such that, due to the magnetic attraction that it generates, it adheres to the metal of the fork on which it is applied.

Such layer can, for example, be obtained with a mixture of ferrite and rubber.

A second layer 4, or superior layer 4, is arranged on the first layer 2 and comes in direct contact with the load without damaging it (for example, without scratching it) and above all, provides a good friction coefficient that prevents slipping of the load.

To that end, rubber materials are particularly suitable. Rubber is particularly suitable because it is soft and at the same time has a high friction coefficient. Therefore, the lifted load, leaning directly on the rubber, is not scratched and is subject to a sufficient friction coefficient to prevent the slipping thereof.

Among the various examples of rubber materials, mention nitrile rubber may be mentioned, which allows contact even with food substances. Other rubbers may be styrene rubber, which has a service temperature up to 70° C. and is suitable for industrial plates; polybutadiene rubber, which has anti-abrasive properties; ethylene-propylene rubber, which is resistant to atmospheric and chemical agents; fluorinated rubber, which is resistant to flames; or SBR rubber (Styrene Butadiene Rubber).

Although rubber is the preferred material for the present purposes, other materials with similar characteristics can be used, without moving apart from the scope of the invention.

For example, wood has both a good friction coefficient and superficial softness such not to scratch metal. Multilayer wood or chestnut oak can therefore be used.

Plastic materials may also be used.

A third layer 3, or intermediate layer 3, is interposed between the inferior layer 2 and the superior layer 4 such to provide sufficient rigidity to the entire device 1, thus avoiding undesired inflexions due to the action of the overlying load, which can cause an irregular adherence.

To that aim, the third layer 3 is preferably made of metal, for example iron, and has a thickness that varies from 1 mm to 4 mm, and is preferably 2 mm. These ranges have been mentioned as preferred, particularly when iron is used, but can vary other metals or alloys are use. For example, an intermediate layer of steel, though more expensive, can allow lowering significantly the above mentioned thickness values.

Other materials of sufficient rigidity may include a high-resistance rigid plastic layer.

The presence of the intermediate layer 3 is particularly important and relevant, above all in the case of heavy loads. In fact, the inflexion of the device 1, and therefore the inflexion of the magnetic layer 2, causes, in addition to a partial detachment due to said inflexion, a change of polarity with a consequent variation of the generated magnetic field. As a consequence, the force F of magnetic adhesion of the device to the forks is also altered, which decreases drastically. In this case, the geometry of the magnetic layer must be kept unaltered as much as possible in order to avoid unexpected drops in sealing. To that aim, the intermediate layer 3 provides an adequate overall rigidity that limits the inflexion of the device.

Moreover, the overlaying metallic layer directs the entire magnetic field downward, causing a greater adherence on the fork to which it is applied.

The presence of the magnet, above all, makes such strips easily applicable at any point of the fork and drawn and successfully applied to the forks every time that is necessary as well as removable at the end of use.

The magnet must be dimensioned to exert a force that is sufficient for avoiding the detachment of the strip during its operative phase. In this case, magnets can be selected that are capable of exerting forces at least equal or superior to 700 N, and preferably, in a range between 700 N and 1500 N.

Such a range allows achieving an adequate seal, optimizing at the same time the dimensions of the magnet.

Figure 2:
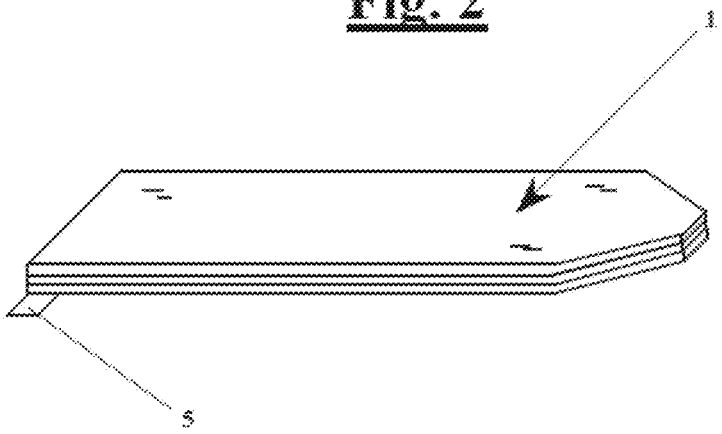
FIG. 2 shows an axonometric view of the device 1.

FIG. 2 shows the device 1 in assembled condition, wherein the three layers have been overlapped and connected between them according to the sequence of FIG. 1. An adhesive material that can be used for coupling the layers may be, for example, common seal glue.

The layer 2 covers the layer 3, having substantially the same shape and the same area.

FIG. 2 highlights an appendix or tang 5, which facilitates the detachment of the device 1 from the fork. Through such an appendix the user can grasp the device and lift it progressively, causing the detachment of the device from the fork.

Although FIG. 2 highlights a solution wherein the tang is applied to the first magnetic layer 2, the same may be connected to any of the described layers.

Preferably, but not necessarily, the layers are cut in the shape of strips that substantially trace the shape of the fork, such that their application on the fork provides a uniform shape.

Figure 3:
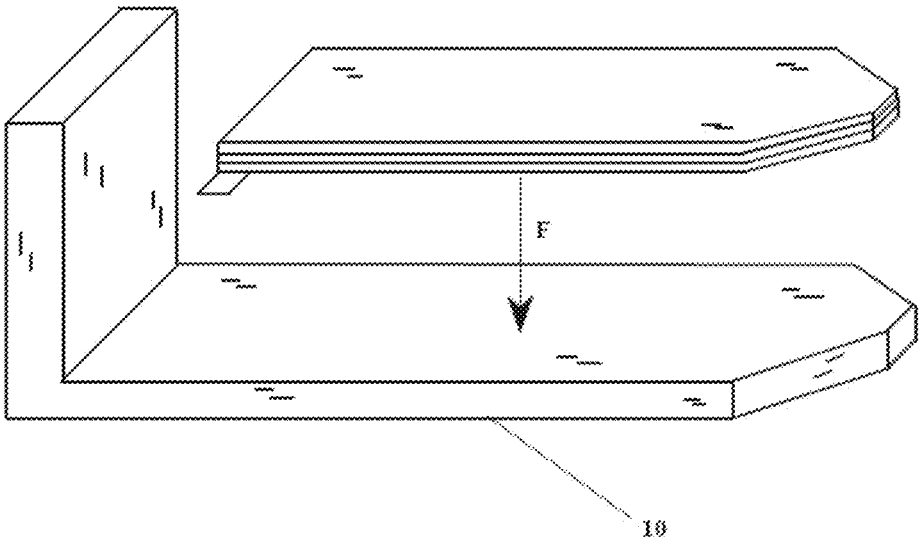
FIG. 3 shows one of its applications to the fork of a lift.
Figure 4:
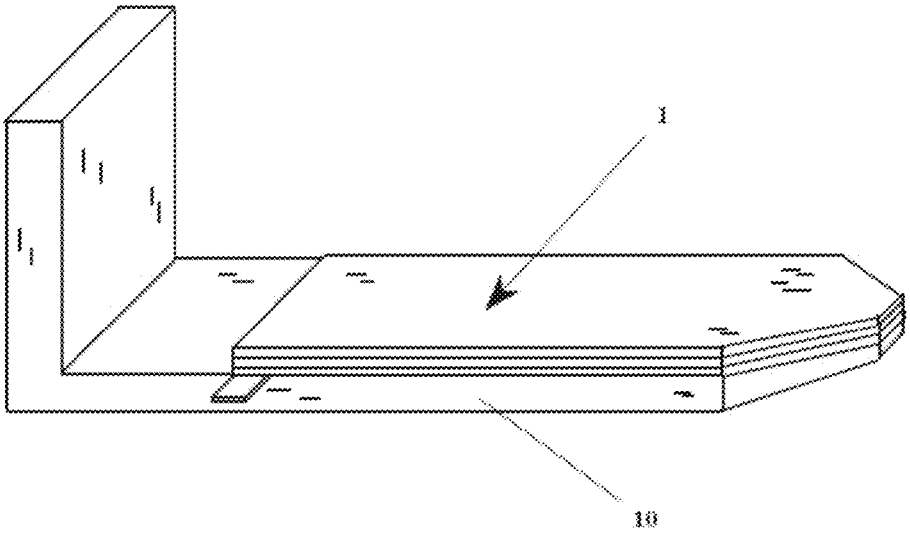
FIG. 4 shows the device 1 applied to the fork.

FIG. 3 shows an example of use, in particular the application of the device 1 on a fork 10 through a magnetic force of attraction F, which is established between the metal of the fork and the magnet that constitutes the layer 2. FIG. 4 shows the device applied to the fork and therefore ready for use.

Figure 6:
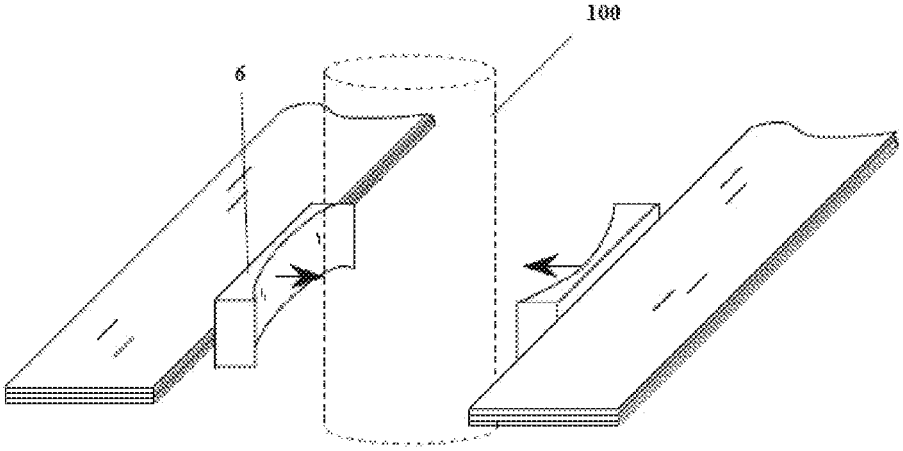
FIG. 6 and FIG. 7 show a second configuration of the invention.

FIG. 6 illustrates a second configuration of a device according to the invention, which is identical to the first configuration but to which a press 6 is added. The press 6 can have different geometrical forms, such as semi-circumferential (that is, C-shaped) or V-shaped. As shown in FIG. 6, such a constructive solution is particularly functional in the case of forks that also move also in relation to each other since they can move apart or come close. The use of an adequately shaped press thus enables grasping objects of particular shapes laterally.

Accordingly, FIG. 6 shows the lateral grasping of a cylinder 100 shown with in dashed lines. Other objects of particular shapes can also be grasped with presses of the same shape.

The grasping surface of the press can be covered with an anti-scratch material, such as rubber.

Figure 7:
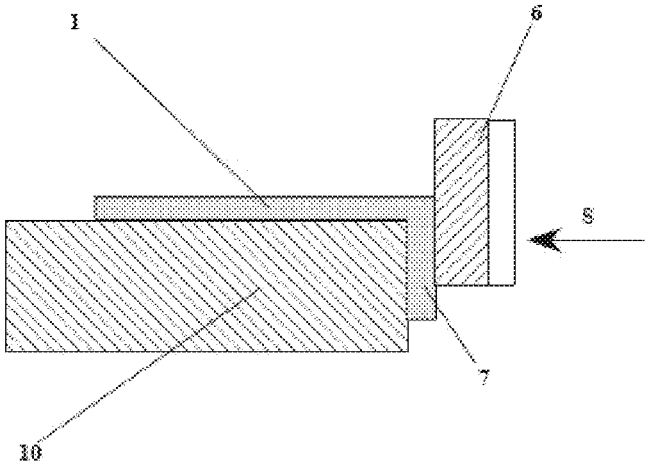

In order to optimize operation, the section of FIG. 7 shows that, in the case of presses rigidly connected to the device 1, the device 1 is preferably made in the shape of an L. In this manner, the thrust S acting on the device 1, due to the grasping action between the forks, will not cause the slipping of the device with respect to the surface on which it is applied, since the appendix 7 of the L shape causes a contrast against the surface of the fork. In this manner, it will be possible to avoid an over-dimensioning of the magnetic layer 2.

The rigid connection of the press to the device 1 can be achieved in different ways, for example by including one or more L-shaped brackets, welded on one side to the press and on the other side to the metallic intermediate layer.

Figure 8:
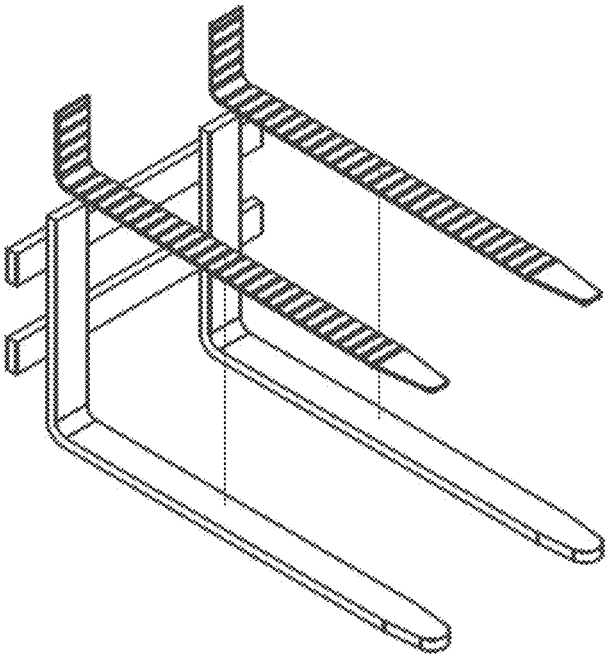
FIGS. 8 to 10 show another device according to the invention.

FIG. 8 shows an additional configuration of the invention, identical to the preceding one, except that instead of the tang 5 there is a strip with its final end 101 lacking the metallic intermediate layer.

Figure 9:
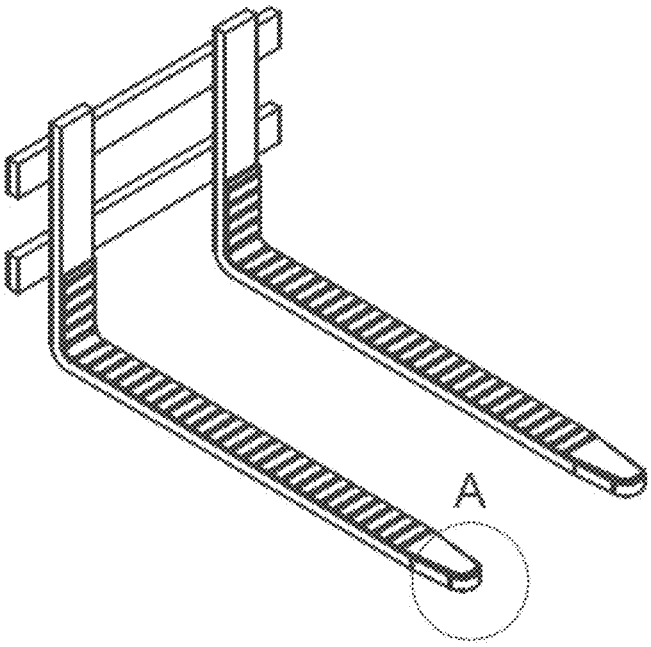
Figure 10:
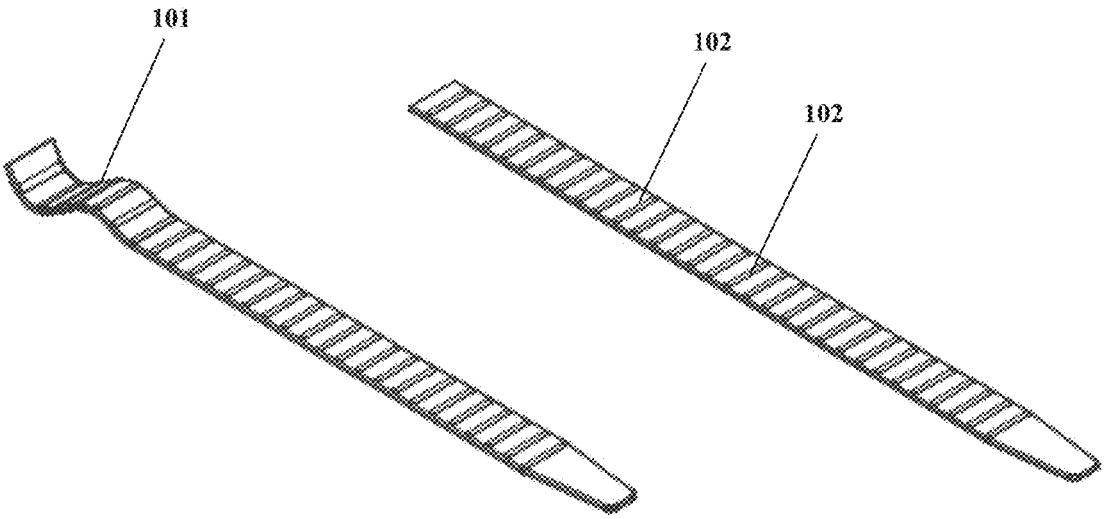

This causes, as shown in FIGS. 8, 9 and in better detail in FIG. 10, a terminal part 101 to be flexible such to be grasped manually and detached on the part of fork to which it becomes applied. Moreover, such a portion can easily follow the L-shaped curved profile of the fork on which it is applied (see FIGS. 8 and 9, for example).

In all the above described configurations, and in particular in the configuration of FIGS. 8 to 10, rises 102 in the rubber of the superior layer of the bubbles are highlighted. These provide a better anti-slip seal of the overlaying load.

In all the configurations of the invention, both the superior layer in rubber and the magnetic inferior layer can be produced with a vulcanization process, arranging the rubber on the metal of the intermediate layer, which is placed in a mold. Alternatively, the rubber may be injected on the metal, still placed within a mold.

Figure 11:
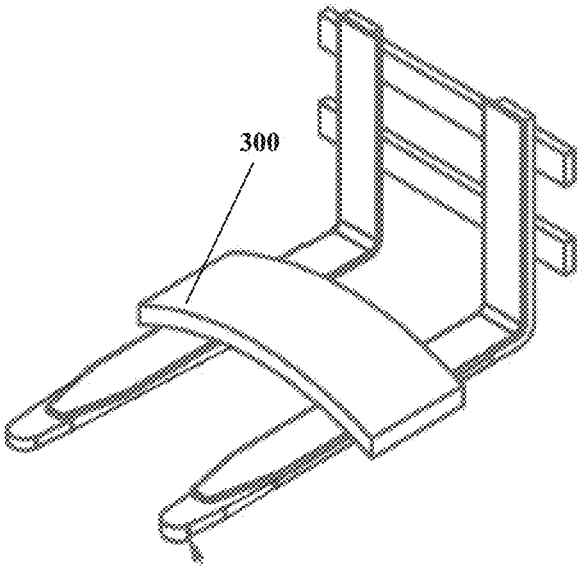
FIGS. 11 to 13 show another device according to the invention.
Figure 12:
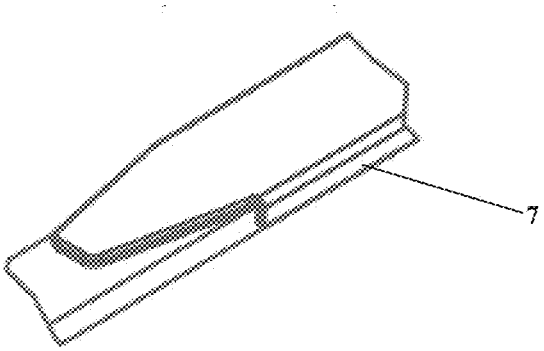
Figure 13:
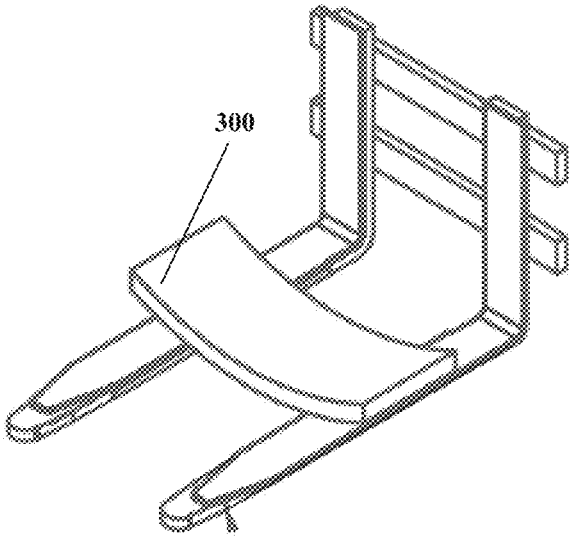

FIGS. 11-13 show a further variant of the invention wherein the strip includes an L-shaped folding 7 on both sides, identical to the one of FIG. 6. In this case, such a folding 7 not only further limits the lateral movements of the strip but also, and above all, as shown in FIGS. 11 and 13, protects the load from direct contact against the angles of the fork in the case of load 300 that is concave or convex.

Figure 5:
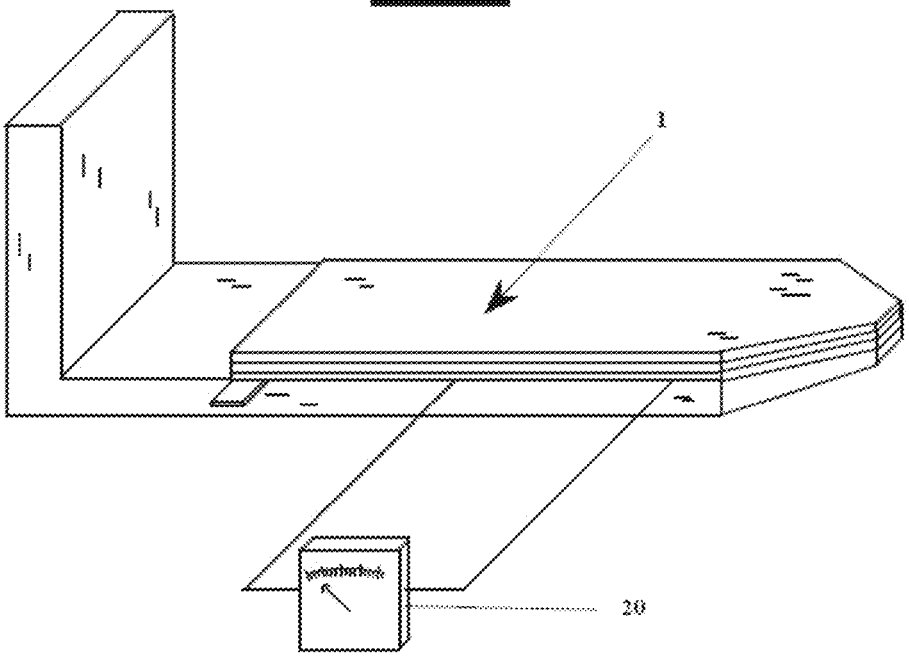
FIG. 5 shows a weight sensor applied to the device 1.

In all the above described configurations, as shown in FIG. 5, it is also possible to provide the device 1 with a weight sensor 20, of a type that is known in the art.

The weight sensor is therefore capable of measuring the weight of the object arranged on the device 1, thus eliminating the additional inconvenience of having to first weigh the object at a weighing station and only then lift with the forks of the lift.

Although the invention is preferably applicable to metallic forks of a lift, it is clear that the same may be equally applied to any lifting surface, such as a loading platform, movable vertically and/or laterally, or to fixed support surfaces such as the deck of a truck or a metallic container. Another application example can comprise applying such strips to the vices of a lift fork for the movement of paper reels. Such vices open, close and rotate in order to grasp and manage paper reels in the industry of paper processing.

The lengths of the strips generally extend for the entire length of the fork and may vary within a range from 1 m to 2 m and more.

Nevertheless, the application of shorter strips or the application in succession of short strips along the fork is possible.

Accordingly, in the embodiments described in FIGS. 1-5, the layer of rubber has a thickness within a range varying from 4 mm to 10 mm.

The metallic layer has preferably a thickness of about 2 mm and the magnetic layer has preferably a thickness of about 1.7 mm.

Accordingly, the device has generally an overall thickness within a range from 7 mm to 13 mm, more preferably from 9 mm to 11 mm.

The rubber layer and also the other layers are internally full, such that those layer do not have tubular shapes with longitudinal cavities therein.

The invention claimed is:

1. A device for a metallic fork of a lift, comprising:

a first magnetic layer comprising a mixture of ferrite and rubber and adapted to magnetically dispose the device (1) on the fork of the lift;

a second rubber layer disposed on the first layer (2), such that the rubber of said second layer, when a load is lifted with said fork, touches directly the load without scratching the load, the rubber further limiting a slipping of the load, the second rubber layer having planar upper and lower surfaces; and an intermediate layer (3) interposed between the first and the second layers that stiffens the device as a whole and limits inflexions thereof, the first layer and the intermediate layer having substantially a same outer perimeter, wherein the intermediate layer (3) has a thickness from 1 mm to 4 mm, and wherein the first layer has a thickness from 1 mm to 3 mm.

2. The device according to claim 1, wherein the second layer is configured as a strip that is internally full, such to prevent a tubular shape of the second layer.

3. The device according to claim 1, wherein the intermediate layer (3) is a metallic layer.

4. The device according to claim 3, wherein the intermediate layer (3) is made of iron or steel.

5. The device according to claim 1, wherein the first layer (2) is configured to exert a magnetic force of at least 700 N.

6. The device according to claim 5, wherein the first layer (2) is configured to exert a magnetic force from 700 N to 1500 N.

7. The device according to claim 1, wherein the second layer (4) includes a plurality of beads on its outer surface that improve anti-slip seal.

8. The device according to claim 1, wherein the device is strip-shaped such to substantially trace a shape of the fork on which the device is applied the device includes a L-shaped folding on lateral sides of the strip.

9. The device according to claim 1, further comprising a press arranged on the device such to enable grasping the load laterally when the device is applied to the fork.

10. The device according to claim 9, wherein the device is L-shaped and comprises an apex, to which the press is connected.

11. The device according to claim 1, further comprising a tang that facilitates detachment of the device from the fork to which the device is applied.

12. The device according to claim 1, wherein a rear end portion of the device lacks the intermediate layer.

13. The device according to claim 1, further comprising a weight sensor that is integrated in the device such to enable weighing a lifted object while positioned on the fork.

14. A mobile surface of a lift, preferably a fork, for lifting a load, comprising:

a device comprising, a first magnetic layer comprising a mixture of ferrite and rubber and adapted to magnetically dispose the device on the fork of the lift;

a second rubber layer disposed on the first layer, such that the rubber of the second layer, when a load is lifted with the fork, touches directly the load without scratching the load, the rubber further limiting a slipping of the load, the second rubber layer having planar upper and lower surfaces; and an intermediate layer interposed between the first and the second layers, the second layer stiffening the device as a whole and limiting inflexions thereof, the first layer and the intermediate layer having substantially a same outer perimeter, wherein the intermediate layer has a thickness from 1 mm to 4 mm, and wherein the first layer has a thickness from 1 mm to 3 mm.

15. A method of lifting a load with a fork of a lift, the method comprising:

applying at least one strip on a surface of the fork, with which the load is lifted, the strip comprising, a first magnetic layer comprising a mixture of ferrite and rubber and adapted to be magnetically applied to the fork in a removable manner, a second rubber layer, disposed on the first layer such a way the rubber, when the load is lifted with the fork, touches the load directly without scratching the load, the rubber further limiting a slipping of the load, the second rubber layer having planar upper and lower surfaces, and an intermediate metallic layer, interposed between the first and the second layers, the intermediate layer stiffening the strip as a whole and limiting inflexions thereof, the first layer and the intermediate layer having substantially a same outer perimeter, wherein the intermediate layer has a thickness from 1 mm to 4 mm, and wherein the first layer has a thickness from 1 mm to 3 mm.

* * * * *